US011975893B1

(12) United States Patent
Rodriguez

(10) Patent No.: US 11,975,893 B1
(45) Date of Patent: May 7, 2024

(54) POSITION ADJUSTABLE INTERIOR LID FOR CONTAINERS

(71) Applicant: Pedro Nicolas Paez Rodriguez, Laguna Hills, CA (US)

(72) Inventor: Pedro Nicolas Paez Rodriguez, Laguna Hills, CA (US)

(73) Assignee: Pedro Nicolas Paez Rodriguez, Laguna Hills, CA (US)

( * ) Notice: Subject to any disclaimer, the term of this patent is extended or adjusted under 35 U.S.C. 154(b) by 0 days.

(21) Appl. No.: 17/803,146

(22) Filed: Mar. 4, 2022

(51) Int. Cl.
*B65D 43/02* (2006.01)
*B65D 51/24* (2006.01)

(52) U.S. Cl.
CPC ..... *B65D 43/022* (2013.01); *B65D 51/242* (2013.01); *B65D 2543/00092* (2013.01); *B65D 2543/0037* (2013.01); *B65D 2543/0049* (2013.01); *B65D 2543/00546* (2013.01); *B65D 2543/00851* (2013.01)

(58) Field of Classification Search
CPC ..... B65D 43/022; B65D 51/242; B65D 2543/00092; B65D 2543/0037; B65D 2543/0049; B65D 2543/00546; B65D 2543/00851
USPC ..... 220/580
See application file for complete search history.

(56) References Cited

U.S. PATENT DOCUMENTS 620,663 A * 3/1899 McCarty ..... B65D 51/26 215/231
1,437,572 A * 12/1922 Vons ..... B65D 39/02 215/298
1,491,325 A * 4/1924 Thomas, Jr. ..... H02G 3/083 29/522.1
2,828,886 A * 4/1958 Thomas ..... B44D 3/12 220/580

(Continued)

FOREIGN PATENT DOCUMENTS

GB 2141413 A * 12/1984 ..... B44D 3/12
GB 2306429 A * 5/1997 ..... B44D 3/12

*Primary Examiner* — Don M Anderson
*Assistant Examiner* — Eric C Baldrighi

(57) ABSTRACT

What is disclosed is a lid for sealing containers containing paint as well as other types of liquids and solids. The lid is flexible and resilient at portions that provide a seal for the container to preserve the contents by reducing off-gas leakage as well as ingress of oxidizing air in order to prevent drying of the contents or other types of deterioration. A handle is provided at a top surface of the lid and which is proximal to the outer structures of the lid. The handle enables a user to utilize thumb and forefinger to squeeze the handle and thereby laterally collapse the lid thereby reducing its lateral dimensions. The central portion of the lid is vertically raised from radially distal portions of the lid to facilitate collapse of the lid when the handle is squeezed. The lateral dimensional reduction enables the lid to more easily fit within the container and furthermore enables its position to be adjusted within the container and thereby enable it to be moved as close to the contents of the container (Continued)

as desired in order to minimize air pockets in the container space directly above the contents. Release of the grip on the handle allows the lid to revert to its original laterally extended position and thereby come into full sealing contact with the interior walls of the container.

22 Claims, 8 Drawing Sheets

(56) References Cited

U.S. PATENT DOCUMENTS

| | | | | | |
|---|---|---|---|---|---|
| 3,924,774 | A * | 12/1975 | Donnelly | B65D 81/245 | 220/580 |
| 4,416,387 | A * | 11/1983 | D'Antonio | B65D 81/245 | 220/579 |
| 4,682,705 | A | 7/1987 | Hurwitz | | |
| D356,034 | S * | 3/1995 | Sugrue | D9/454 | |
| D363,429 | S * | 10/1995 | Lee | D9/454 | |
| 8,960,475 | B1 * | 2/2015 | Peters | B65D 43/022 | 220/796 |
| 9,394,087 | B2 * | 7/2016 | Phillips | B65D 47/12 | |
| 9,457,939 | B1 * | 10/2016 | Peters | B65D 43/022 | |
| 9,517,865 | B2 * | 12/2016 | Albers | B65D 43/022 | |
| 9,957,089 | B2 | 5/2018 | Rogers | | |
| 10,766,670 | B2 * | 9/2020 | Kittmann | B65D 43/0202 | |
| 11,298,972 | B1 * | 4/2022 | Zeyger | B44D 3/127 | |
| 2004/0238544 | A1 * | 12/2004 | Miller | B65D 81/245 | 220/578 |
| 2022/0297908 | A1 * | 9/2022 | Jacobs | B65D 51/1644 | |

* cited by examiner

POSITION ADJUSTABLE INTERIOR LID FOR CONTAINERS

CROSS REFERENCE TO RELATED APPLICATIONS (not applicable)

STATEMENT REGARDING FEDERALLY SPONSORED RESEARCH OR DEVELOPMENT (not applicable)

THE NAMES OF PARTIES TO A JOINT RESEARCH AGREEMENT (not applicable)

REFERENCE TO A SEQUENCE LISTING (not applicable)

STATEMENTS REGARDING PRIOR DISCLOSURES BY THE INVENTOR OR A JOINT INVENTOR (not applicable)

BACKGROUND OF THE INVENTION

The invention generally relates to lids for containers containing liquids such as paint, beverages and semi-liquids such as certain types of food. The invention specifically relates to lids that can seal such containers after the containers have been opened and some of such container contents removed.

The invention addresses the problem of premature drying of compositions such as paints inside of containers particularly after the containers have been opened and some of the contents removed so that less than a full container of contents remain in the container. Since the paint or other type of content composition remaining in the container is still good, users while typically replace the lid and store the container. But deterioration of such container contents while in storage is problematic and prevents reuse. While in storage, drying or curing of compositions inside the containers results in hard particles seen as skin or it results in undesirable thickening of the contents while in the containers. Such drying may be caused by factors such as increased temperature, change in temperature, and the amount of or the humidity of the air trapped inside the packaging.

Skinning refers to a specific form of premature drying where a coherent layer of a fluid composition (e.g. such as a thin layer of paint at the underside of a paint container lid) undergoes premature drying on one or more surfaces inside a container for such compositions. Such premature drying may occur in, for example, water-based paints due to coagulation, a process in which some or all of the water and solvents evaporate the binder particles in the paint fuse together irreversibly bound into network structures. This off-gassing of the contents of the container after the container is opened and some of the contents removed will thus result in deterioration of the contents. In addition, premature drying may occur in solvent-based paints due to the uptake of oxygen leading to the oxidative cross-linking of the paint. What results is similarly a loss in quality and therefore usefulness of the paint while in storage.

If a considerable portion of paint of a full container is removed, off-gassing of the paint will substantially increase in comparison to that of a relatively full container due to the enlarged air space above the liquid paint which promotes such off-gassing. Off-gassing into the enlarged air-space will continue until the air-space is saturated with the gas. Consequently, regardless of whether or not gas leaks out of the container, more gas will be released into the air-space. Depending on the relative size of the air-space the increased amount of gas in the air-space may be enough to produce considerable deterioration of the paint. The result is that the liquid paint within the container forms a skin on its surface and will eventually dry out thereby becoming unusable.

With regard to containers which contain carbonated beverages, the enlarged air-space in the container that results after it is opened and some of the beverage is removed will similarly result in undesirable loss of carbonation. The enlarged air-space in the opened container will promote escape of the carbon dioxide gas from the liquid and into the air-space which is not gas saturated due to the entry of the new air into the container. The enlarged air-space is thus able to take a considerable amount of carbon dioxide from the liquid therein and undesirably hold it in solution in the air. As a result the beverage lacks carbonation such that it tastes flat and is therefore likely to be prematurely discarded.

With regard to containers which contain food or other types of perishable contents, the enlarged air-space in the container that results after it is opened and some of the contents removed will also result in deterioration of the food or other perishable contents. This is because the enlarged air-space in its entirety contains more oxygen due to entry of the new air which through circulation therein thereby promotes oxidation of the food or the like hastening deterioration of the quality thereof after the container is opened and some of the contents removed. This may be especially detrimental for some foods which have nutrients that are very oxygen sensitive. This is evident in the rapid discoloration of some fruits and vegetables that may be stored in containers that may be airtight but nevertheless have air pockets in the containers. For example, guacamole spread can quickly turn brown rendering it at least unappetizing in appearance and therefore likely to be promptly discarded. Consequently, it is insufficient to simply seal such a container after it is opened and contents removed or after food has been newly put into it and thereby expect to prevent deterioration of the contents.

In the prior art some designers of improved versions of such containers as well as users of conventional containers have sought to improve the seal provided by the lid after it has been opened. Users have often installed a cellophane sheet between the lid and the container groove that it fits into in an effort to remove gaps between the lid and container and thereby enhance the seal. Designers of prior art improved versions of container structures have provided rubber gaskets to provide improved sealing. However, such efforts to prevent deterioration of the contents have been largely ineffective and unsuccessful. The cause of the deterioration is not only that the container allows off-gasses, carbonation and the like to escape from the previously opened container. Instead, the primary problem is the enlargement of the air-space once the container is opened and some of its contents removed so that gasses escape from the contents into the air-space. The greater the amount of contents removed the greater the undesirable effects of such removal of contents using such prior art solutions. These prior art solutions do not directly address the primary cause of the undesired deterioration.

Various other types of solutions have been designed which have attempted to prevent skinning. Prior art solutions include providing a thin film of water or other protecting fluid on the hulk liquid contents of the container. Similarly other prior art solutions include providing a lid having reservoirs to hold liquid compositions therein as a result of the surface tension of the liquid composition or capillary action. However, these designs are too complicated and too expensive to provide pragmatic solutions to the problem.

What is therefore needed is a lid that will prevent deterioration of paint and other liquids and solid container contents while in storage and after the container has been opened and a portion of the contents removed that is effective and easy to use. What is also needed is such a lid that may be quickly put to use. What is further needed is such a lid that is simple in structure and function and therefore also inexpensive.

BRIEF SUMMARY OF THE INVENTION

It is a principal object of the present invention to provide a lid for containers that may be installed in the interior of the containers.

It is another object of the present invention to provide a lid for containers that may be manually installed within the interior of the containers, It is another object of the present invention to provide a lid for containers that may be positioned at any desired location within the interior walls of the containers in order to be able to accommodate containers that have various amounts of container contents remaining therein.

It is also object of the present invention to provide a lid for containers that enables a user to have sufficient control over the lid insertion to be able to position it as close to the container contents to minimize air pockets between the lid and container contents to the extent deemed best for preservation of the contents.

It is also object of the present invention to provide a lid for containers that is reusable.

It is also object of the present invention to provide a lid for containers that provides dimensional reduction in size of the lid to facilitate insertion into the containers and adjustment of the location of the lid within the containers.

It is an object of the present invention to provide a lid for containers that is easy to use.

It is still another object of the present invention to provide a lid for containers that composed of materials that enable adequate and easy cleaning of the lid so that it may be used with various types of container contents.

It is another object of the present invention to provide a lid for containers that may be properly used without requiring any tools.

The present invention provides a lid which may be removably inserted in the interior of a container after it is opened and some of the contents removed. The interior lid's unique design enables a user to be able to move it up and down within the container thereby enabling it to be positioned at any desired suitable location within the open space of the container. The lid is thus position adjustable within the interior of the container. Once placed in the desired position, the lid has a sealing edge structure in contact with the interior walls of the container that provides an air and liquid tight seal between the edge of the lid and the interior walls of the container. This allows the lid of the invention to in effect seal off a particular portion of the container from another portion. This feature enables the lid to be used to minimize the size of the air-space above the contents of the container. The lid may be positioned so that it is in contact with the container contents. In such a desired position, the size of the air-space that is above and thereby interacting with the contents is reduced or the air-space may be entirely eliminated. Consequently, off-gassing of the contents is concomitantly reduced or eliminated. Thus, the paint or other type of liquid contents will not form a skin on its surface or dry out over time. The useful life of the paint or other contents is thereby prolonged. For this reason, the entirety of the carbon dioxide of carbonated beverage contents will likely remain in the contents, or carbon dioxide escape therefrom will be reduced because there is no air or less air for the carbon dioxide to escape into. Consequently, the interior lid of the present invention will enable beverages to retain their desired effervescence and therefore no premature discarding of the beverages. Similarly, with regard to food applications, the reduced air space will reduce oxidation of the food because there is less oxygen or possibly no oxygen for the food to come into contact with. Consequently, there will likely be no discoloration of the food and therefore no premature discarding of the food.

The lid of the invention is structured so that once the container is opened the lid may be manually inserted into the container. The lid is also structured so that it may be manually moved into any desired position within the container suitable for sealing the container. The peripheral portion of the lid is round or has another suitable geometric shape to conform to the particular geometric shape of the container so that the edge of the peripheral portion of the lid engages the interior lateral walls of the container. The lid has a squeeze handle so that when the members thereof are squeezed together the result is reduction of one lateral diametrical dimension of the lid such that the lateral dimensional size of the lid is reduced so that it do not impede relative movement between the lid and the container walls at that lateral dimension thereof. The collapsed configuration of the lid also allows the lid to be tilted along the axis of the lateral dimension of the lid prior to collapse so that in the collapsed position the dimensional size is reduced enough to present no impediment to relative movement between the lid and the interior walls of the container. Thus, in this reduced size the lid can be installed in containers of various diametrical sizes. The squeezable handle members also facilitate moving the lid vertically within the container to adjust the position thereof relative to the top surface of the liquid or other type of contents. This enables the lid to be positioned preferably as close to the top surface as practical to thereby minimize the size of the air space above the body of liquid. Upon release of the squeeze handle, due to its material composition, the lid reverts back to its un-collapsed configuration wherein the component structures of the lid extend fully so as to come into full contact with the interior walls of the container. Although the lid is specifically adapted for container contents that are liquid, the novel interior lid of the present invention may also be used for container contents that are gel or semi-solid or various other types of compounds that may be prone to off-gas or be vulnerable to oxidation from the air in the container.

The lid is adapted for containers that have a large mouth relative to the cross-sectional dimensions of the main body of containers so that the lid does not have to be reduced in size very much i.e., so that the range of diametrical size adjustment is not excessive. Limiting the range reduces the likelihood that the lid would be excessively non-circular at its circumference at extremes of its range of diametrical size adjustment and thereby not be able to make full contact with the walls of containers of sizes that are at the extremes of its range of size accommodation.

DETAILED DESCRIPTION OF THE INVENTION

Figure 2:
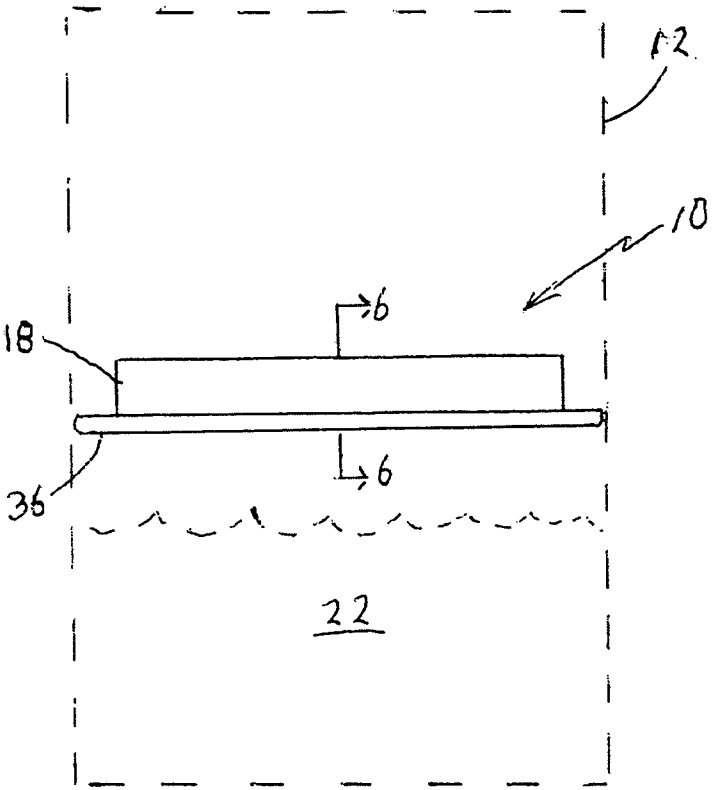
FIG. 2 is an elevational view of the first embodiment of the lid of the invention showing the container and its liquid contents in phantom and showing the lid positioned in the container in its functional extended configuration and illustrating the lid proximal to the liquid providing effective storage utility.
Figure 1:
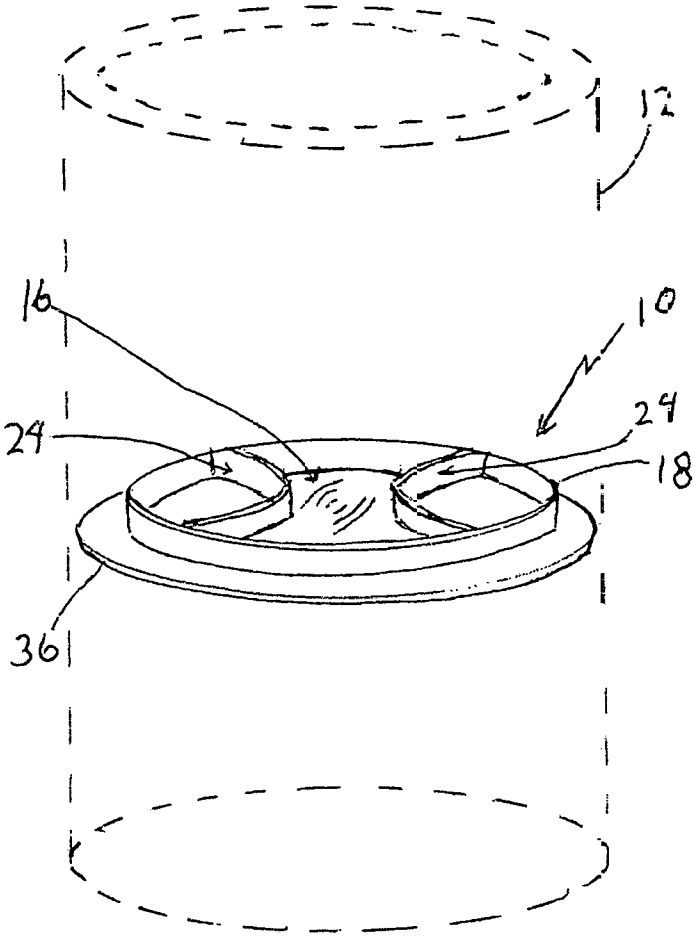
FIG. 1 is an perspective view of the first embodiment of the lid of the invention showing the container in phantom and showing the lid positioned in the container in its functional extended configuration in which it provides sealing of the container.

The interior lid of the present invention is designed to be manually inserted into a relatively large mouth container after some of the liquid (or gas, gel, semi-solid, or solid) contents 22 thereof have been removed. The first embodiment 10 of the lid of the present invention is generally and overall circular. The lid 10 includes an inner member 16 which is approximately planar. The lid 10 also includes an outer member 18 which is preferably approximately cylindrical. The outer member 18 is attached to the inner member 16 at longitudinal end portions 20 thereof. The longitudinal end portions 20 are preferably semi-circular in order to enable full contact with the cylindrical outer member 18 for proper attachment thereto. The lid 10 also includes a squeeze handle 24 attached to the inner member 16. The squeeze handle 24 preferably is a pair of gripping members 24 that includes a left gripping member 26 and a right gripping member 28 that are in opposing orientation. The left gripping member 26 is preferably attached to the inner member 16 at its left lateral end portion 30. Similarly, the right gripping member 28 is preferably attached to the inner member 16 at its right lateral end portion 32. The left lateral end portion 30 is semi-circular to approximately conform to the contour of the semi-cylindrical left gripping member 26. Similarly, the right lateral end portion 32 is semi-circular to approximately conform to the contour of the semi-cylindrical right gripping member 28. The inner member 16 includes an apex 34 which is approximately centrally located on the inner member 16. As shown, left and right lateral end portions 30 and 32 are positioned at locations that are outward relative to the apex 34. A peripheral member 36 is attached to the outer member 18 at the outer surface 38 of the outer member 18. The peripheral member 36 is an annular ring structure which preferably includes an edge 40 which extends all the way around the peripheral member 36. When the lid 10 is installed in the container 12, the edge makes approximately full contact with the interior walls 14 of the container 12 to provide sealing between the lid 10 and the walls 14. A left lateral member 42 is located between the outer member 18 and the left gripping member 26 and attached thereto. A right lateral member 44 is located between the outer member 18 and the right gripping member 28 and attached thereto.

Figure 4:
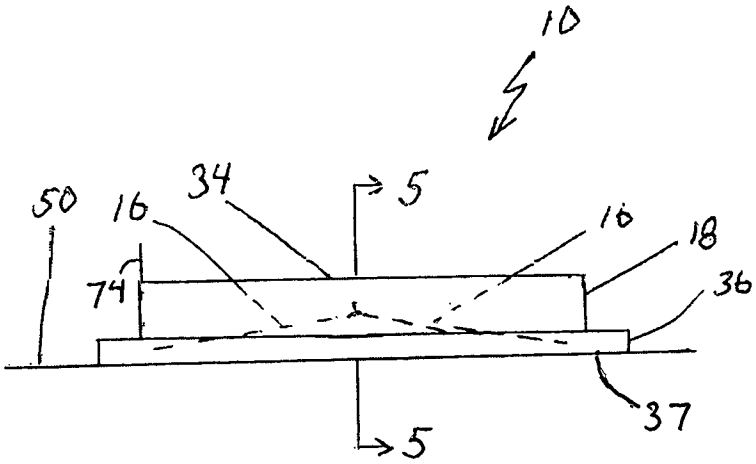
FIG. 4 is an elevational view of the first embodiment of the lid of the invention showing the lid in its extended state and showing the component structures thereof and showing the plane of the lid.
Figure 3:
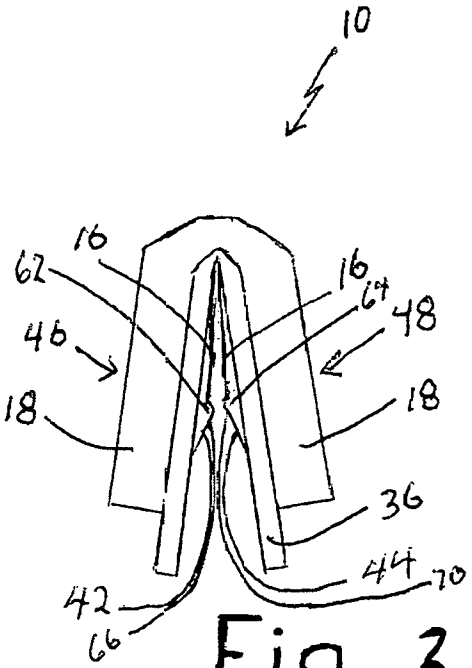
FIG. 3 is an elevational view of the first embodiment of the lid of the invention showing the lid in its collapsed state and illustrating the configuration of the component structures thereof in the collapsed state and showing the plane of the lid.

As shown in FIG. 4, the left gripping member 26 and the right gripping member 28 extend vertically upward from the inner member 16 and are attached at their left outer gripping member ends 86 and right outer gripping member ends 88 to the outer member 18 The members 26 and 28 are curved away from the inner member 16. The members 26 and 28 are approximately semi-cylindrical. The degree of curvature and the height of the members 26 and 28 provide a good fit for the typical user's thumb and forefinger (or a plurality of forefingers) for comfort and ease of use. The members 26 and 28 are preferably at laterally opposing locations at the end portions 30 and 32 of the inner member 16. With a thumb on the left gripping member 26 and a forefinger on the right gripping member 28 (or vice-versa), the user can bring the members 26 and 28 together in a squeezing motion so that the members 26 and 28 fold together with the left main body 46 and right main body 48 rotating downward about the axis 50. Axis 50 preferably extends longitudinally. This rotation thereby brings the left and right main bodies 46 and 42 into contact or proximal thereby moving the lid into a collapsed configuration. In the collapsed configuration the lateral dimensions of the lid 10 are reduced allowing the lid 10 to laterally clear the interior walls 14. This results in the lid 10 becoming laterally dimensionally smaller facilitating its manual insertion into the container 12. It also generally facilitates its manual movement up and down within the container 12 to facilitate positioning and repositioning of the lid 10 in the container 12. Moreover, in the collapsed configuration the lid 10 may be tilted or rotated in a longitudinal direction to additionally reduce the longitudinal dimensions of the lid 10 relative to the diametrical dimensions of the container 12 rendering the lid 10 diametrically smaller in the longitudinal dimensions further facilitating movement of the lid 10 within the container 12. As a result of this unique collapsed configuration, a user can find it easy to insert the lid 10 into and position the lid 10 within the container 12. The left gripping member 26 and the right gripping member 28 are preferably positioned so that corresponding locations are equidistant from each other and from the axis 50 in order to provide a smoother folding movement. The left main body 46 contains the left gripping member 26, and the right main body 48 contains the right gripping member 28.

Squeezing the handle (or pair of gripping members) 24 may instead tend to rotate the main bodies 46 and 48 in an upward rather than the desired downward direction if the squeezing forces are not properly directed. Therefore, in order to ensure that in response to squeezing of the handle 16 the main bodies 46 and 48 rotate in the desired downward direction the apex 34 of the inner member 16 is positioned in a location in which it is raised relative to left lateral end portion 30 and right lateral end portion 32 as well as to other portions of the lid 10 distal from the apex 34. The inner member 16 slopes downwardly from the apex 34 to distal portions of the lid 10. As a result of this raising or elevation of the inner member 16, the left base portion 46 of the left gripping member 26 and the right base portion 48 of the right gripping member 28 are lower than the apex 34 as well as other portions of the inner member 16 situated between the gripping members 26 and 28. Consequently, the squeezing forces exerted on the inner member 16 are concomitantly lower than the apex 34 thereby tending to induce a rotational movement such that they move the apex 34 upwardly and move the lateral end portions 30 and 32 downwardly. This helps ensure that squeezing the handle 16 will produce the desired downward folding movement of the main bodies 40 and 42. The apex 34 is therefore raised upwardly from the axis 50 approximately five mm when used in a five gallon paint container. Although the apex 34 is not in longitudinal alignment with the axis 50 of rotation, the lid 10 is composed of a flexible material that is sufficiently flexible to enable it to possibly distort i.e., stretch, compress or ripple or the like without undue restriction to such rotation and without breaking or fracturing.

The outer member 18 is preferably cylindrical with its vertical axis 56 extending through the apex 34. The cylindrical shape provides a degree of stiffness and structural strength to the lid 10 and this renders the lid 10 more stable when positioned within and against the walls 14 of the container 12. Consequently, the stability this structure provides renders the lid 10 more likely to remain in its desired sealing position when in use. The outer member 18 is sufficiently thick and tall to enhance its stiffness and structural strength. When used in a container 12 that is a standard five gallon paint container, the outer member 18 is preferably ten mm tall and one mm thick.

The axis 56 is preferably perpendicular to a plane 58 which includes the longitudinal axis 50. The intersection of the longitudinal axis 50 and the vertical axis 56 defines the center 60 of the lid 10. Since the plane 58 is not a physical structure it is shown in phantom in FIG. 6. In addition, the left medial portion 80 of the gripping member 26 and the right medial portion 82 of the gripping member 28 are raised approximately two mm from the plane 58.

Figure 6:
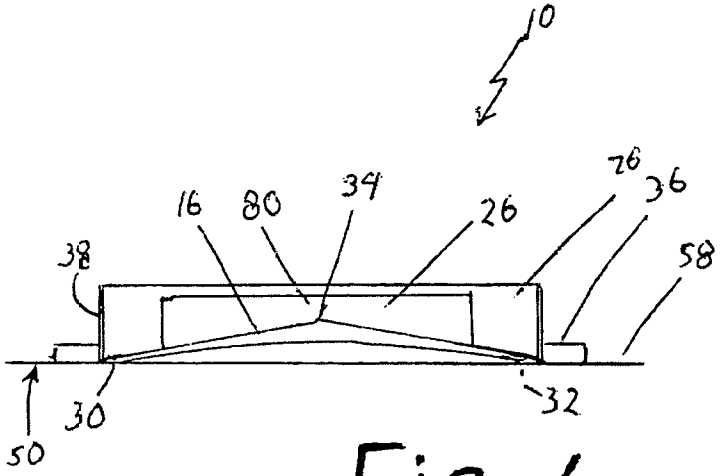
FIG. 6 is an elevational view of the first embodiment of the lid of the invention showing a side vertical sectional view of the lid taken along line 6-6 of FIG. 2.
Figure 5:
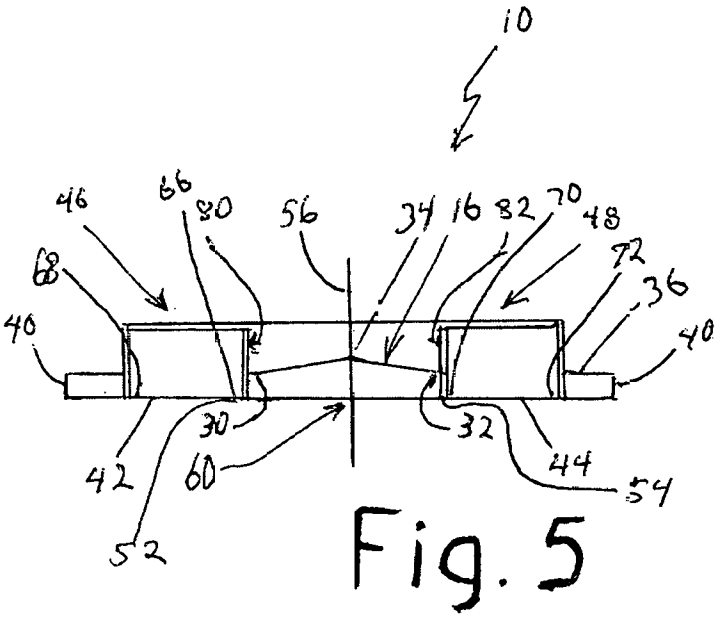
FIG. 5 is an elevational view of the first embodiment of the lid of the invention showing a front vertical sectional view of the lid taken along line 5-5 of FIG. 4.
Figure 8:
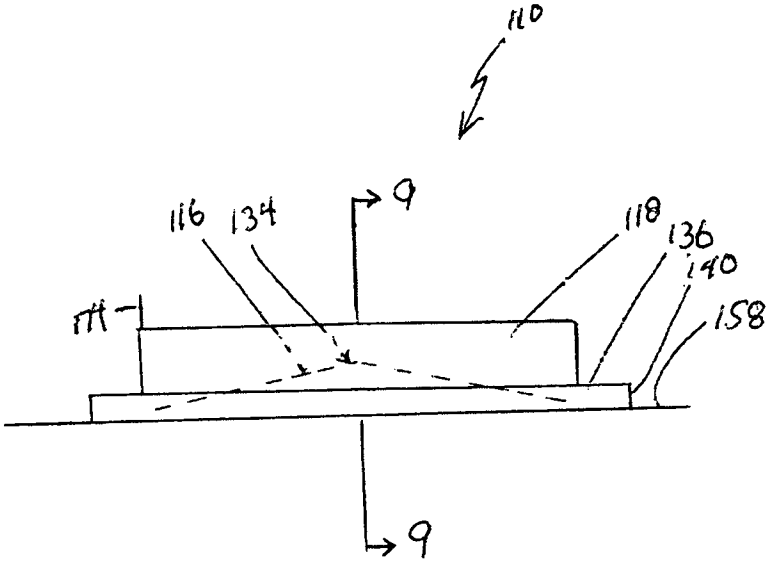
FIG. 8 is an elevational view of the second embodiment of the lid of the invention showing the component structures thereof.
Figure 7:
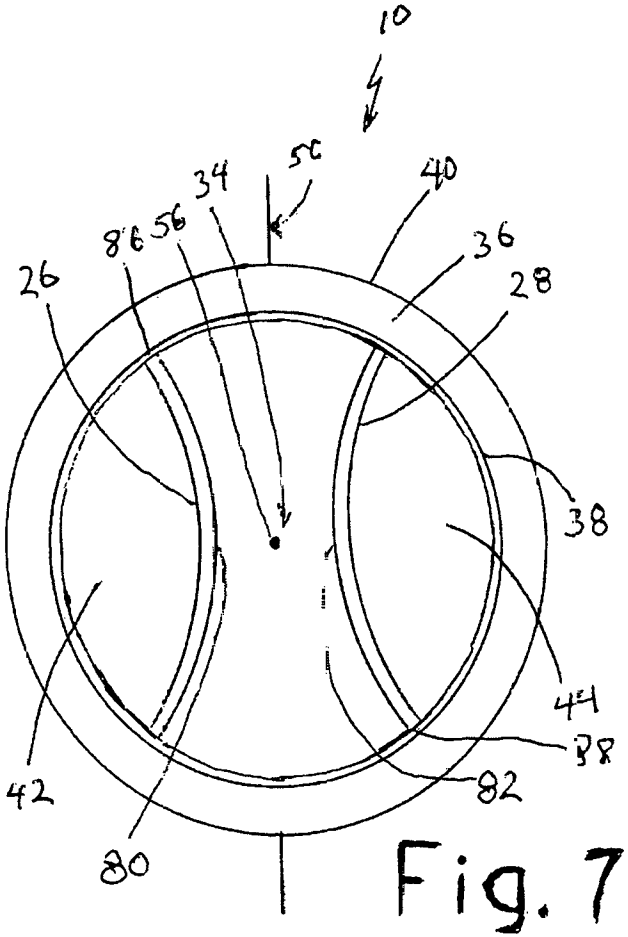
FIG. 7 is a top view of the first embodiment of the lid of the invention showing the component structures thereof.
Figure 10:
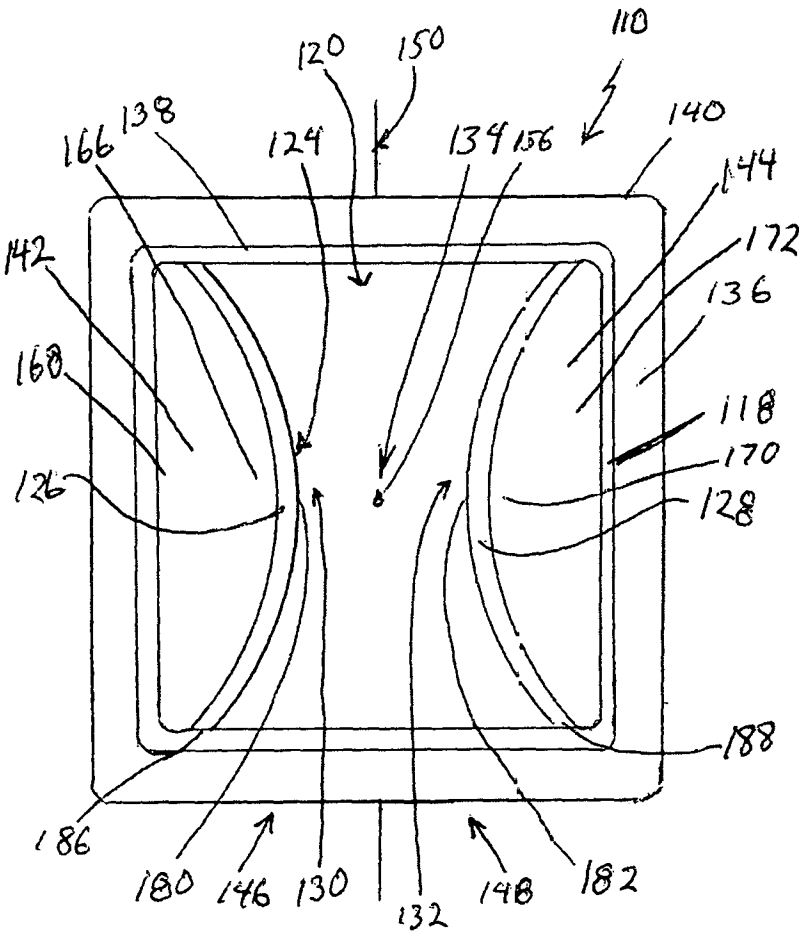
FIG. 10 is a top view of the second embodiment of the lid of the invention showing the component structures thereof.
Figure 9:
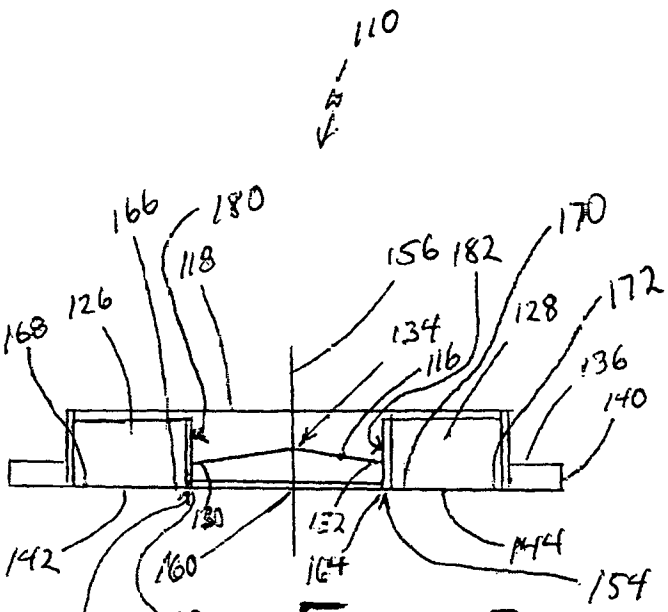
FIG. 9 is an elevational view of the second embodiment of the lid of the invention showing a vertical sectional view of the lid taken along line 9-9 of FIG. 8.
Figure 12:
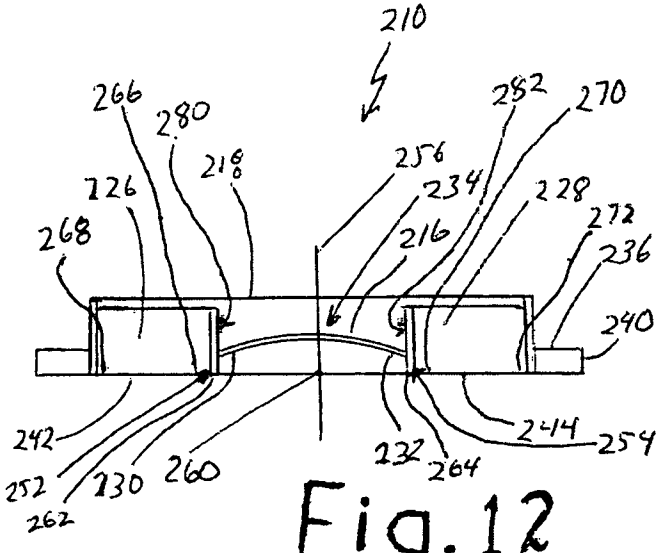
FIG. 12 is an elevational view of the third embodiment of the lid of the invention showing a vertical sectional view of the lid taken along line 12-12 of FIG. 11.
Figure 11:
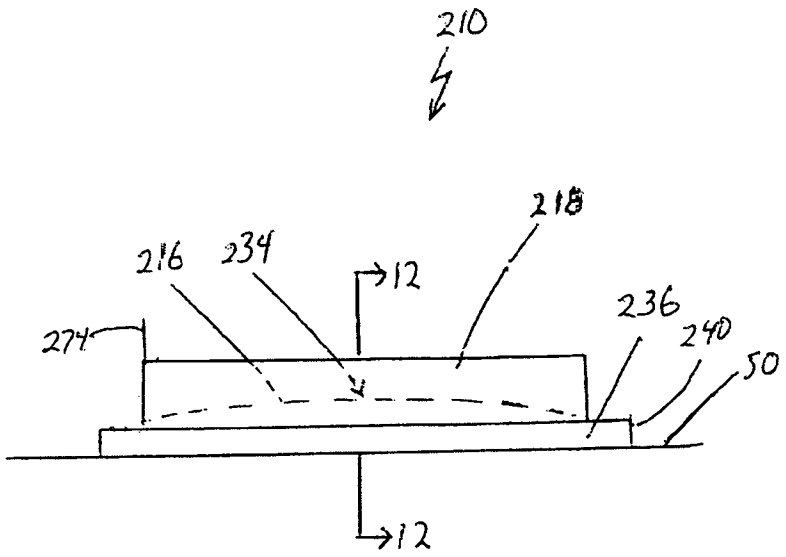
FIG. 11 is an elevational view of the third embodiment of the lid of the invention showing the component structures thereof.
Figure 14:
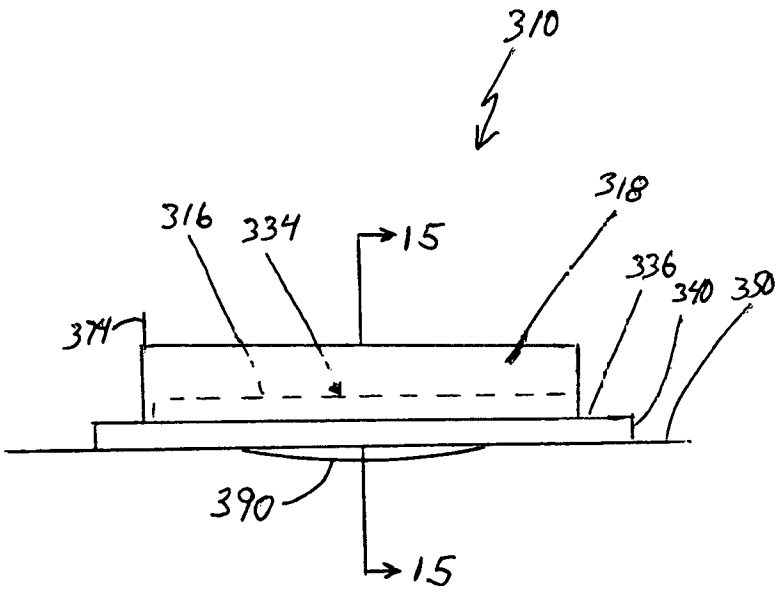
FIG. 14 is an elevational view of the fourth embodiment of the lid of the invention showing the component structures thereof.
Figure 13:
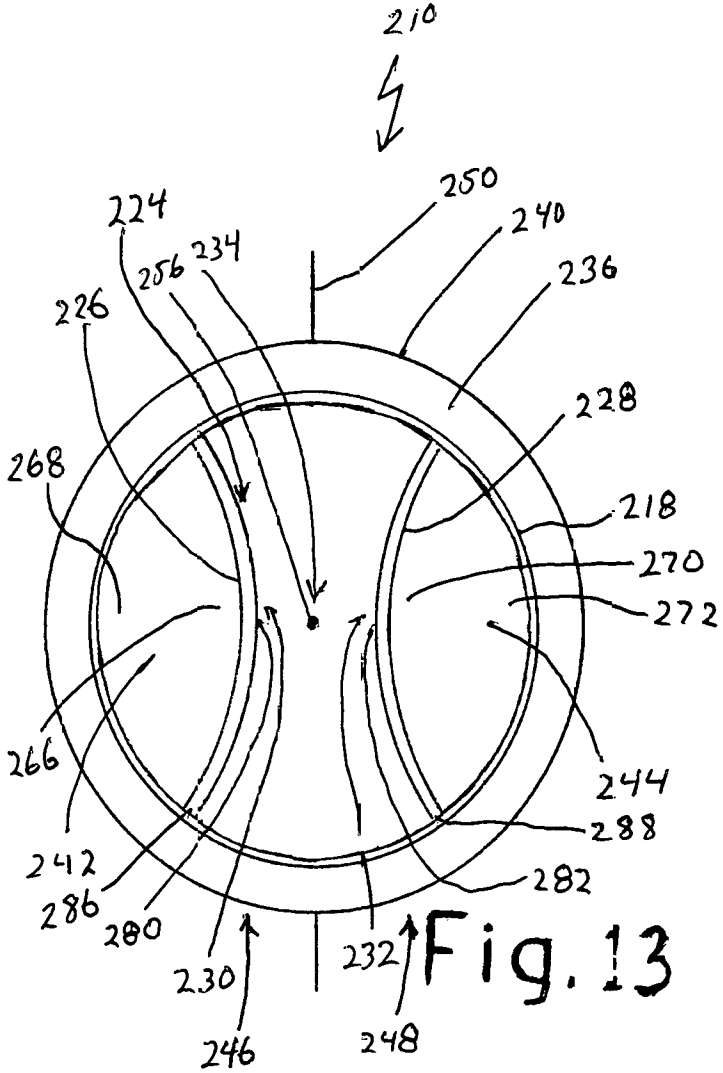
FIG. 13 is a top view of the third embodiment of the lid of the invention Showing the component structures thereof.
Figure 16:
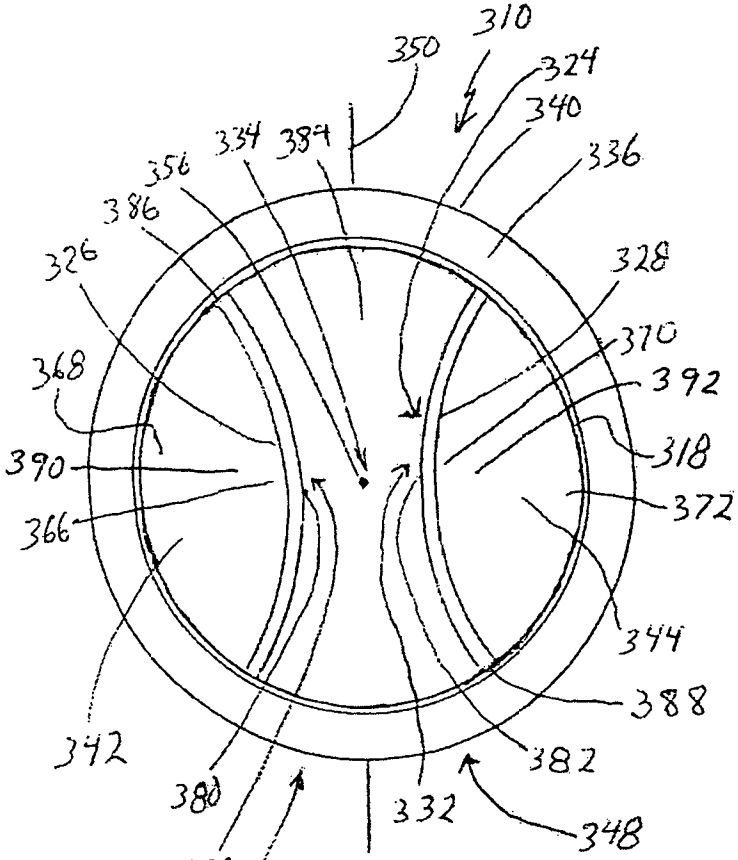
FIG. 16 is a top view of the fourth embodiment of the lid of the invention showing the component structures thereof.
Figure 15:
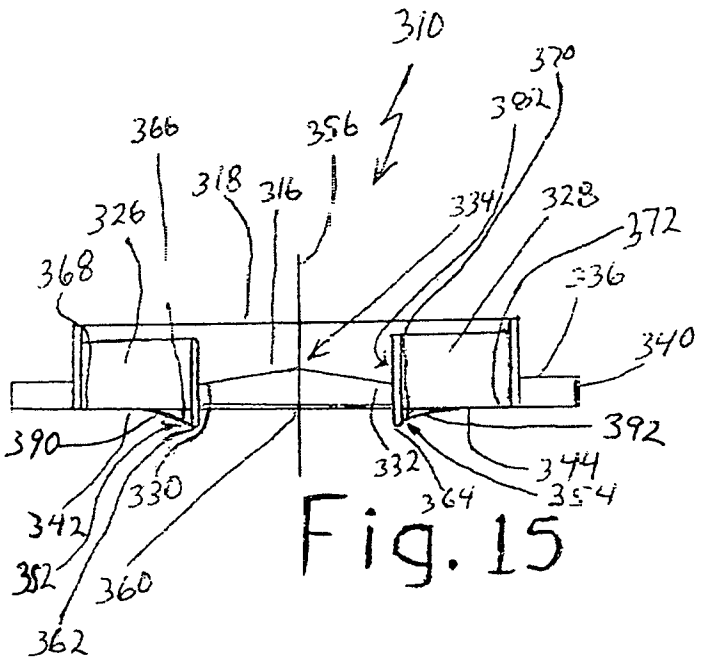
FIG. 15 is an elevational view of the fourth embodiment of the lid of the invention showing a vertical sectional view of the lid taken along line 15-15 of FIG. 14.

The apex 34 of the inner member 16 is preferably raised approximately five mm from the plane 58. Thus, as FIGS. 4, 5 and 6 show the inner member 16 is in the shape of a cone with the point of the cone at the apex 34.

The left base end 62 of the left gripping member 26 and the right base end 56 of the right gripping member 28 lie in the plane 58. The bottom surface 37 of the peripheral member 36 preferably is in the plane 58. Alternatively, peripheral member 36 may be at a medial location on the outer member 18 or in the plane 58 and thus in alignment with the axis 50. The peripheral member 36 is preferably proximal the base ends 78 of the outer member 18.

The lid 10 also includes a left lateral member 42 and a right lateral member 44. The left lateral member 42 is preferably attached at its inner left lateral member end 66 to the left gripping member 26. The left lateral member 42 is preferably attached at its outer left lateral member end 68 to the outer member 18. The right lateral member 44 is preferably attached at its inner right lateral member end 70 to the right gripping member 28. The right lateral member 44 is preferably attached at its outer right lateral member end 72 to the outer member 18. Left and right lateral members 42 and 44 are outward of the gripping members 26 and 28 where the gripping members 26 and 28 are used to exert the desired rotational folding forces. Therefore, these lateral members 42 and 44 are not needed to effectuate the desired folding movement. Consequently, these lateral members 42 and 44 are positioned lower than most other portions of the lid 10 to bring them closer to the container contents 22 and thereby minimize air pockets. Lateral members 42 and 44 thus are in the plane of the longitudinal axis 50, the left and right base ends 62 and 64 and the outer member base ends 78. Lateral members 42 and 44, left and right base ends 62 and 64 and outer member base ends 78 are co-planar. Left main body 46 contains left lateral member 42, and right main body 48 contains right lateral member 44.

The peripheral member 36 is preferably planar and circular. Peripheral member 36 extends outwardly and radially from the apex (or central area of the inner member) 22. More specifically, peripheral member 36 preferably extends outwardly and radially from the center 60 of the lid 10 as well as the axis 50. This orientation of the peripheral member 36 relative to the center 60 and axis 50 positions the peripheral member 36 approximately perpendicular to the walls 14 of the container 12 thereby providing a more stable engagement of the peripheral member with the walls 14. The peripheral member 36 includes the edge 40 which is located at the perimeter of the peripheral member 36 for direct contact with the walls 14. Edge 40 is preferably composed of silicone or rubber to enhance sealing between the lid 10 and the interior of the container 12. The resilience eliminates or reduces gaps between the edge 40 and the walls 14. In addition, the silicone or rubber composition enables the lid 10 to conform to containers having imperfect diametrical size or other than perfectly circular shape. The peripheral member 36 is preferably sufficiently wide i.e., extending outwardly from the center, that it can bend or deflect in response to the force of pushing downward on the lid 10. When bending, the peripheral member 36 has sufficient structural integrity to be able to maintain its desired seal with the container walls 14. The characteristic of being able to so bend provides a degree of reduction of dimensional diametric size of the lid 10 so that it can conform to smaller sized containers as well as imperfections in diametrical size and circular shape than otherwise. Thus, this feature allows the lid 10 to be installed and used in containers of a desired range of diametrical sizes and circular shapes.

A lift tab 74 is provided to facilitate removal of the lid 10 from the container 12. When the container has been in storage a long time it may become difficult to move up and down within the container. The lift tab 74 is attached to the outer member 18 preferably at an inner surface 76 thereof is sufficiently wide and sufficiently tall to enable a user to easily find, grip and pull it thereby sliding the lid 10 from the container 12.

The lid 10 is preferably sufficiently resilient and flexible to enable easing folding thereof and therefore is preferably composed of silicone, rubber, plastic or polymer. Alternatively, other types of materials having suitable characteristics of flexibility and resiliency may also be used. In addition, the material preferably has memory so that upon release of the squeeze on the squeeze handle 24, the lid 10 will spring back into its original uncollapsed shape and dimensions.

The lid 10 preferably also integral and unitary to provide structural strength and ease of manufacture. Alternatively, however, the components described above as attached may be fused or otherwise bonded by various suitable means.

The second embodiment 110 of the invention also provides an interior lid 110 for insertion in a suitable container 112 filled to a certain extent with contents 122. Embodiment 110 includes a left main body 146 and a right main body 148 as well as a left gripping member 126 and a right gripping member 128. Like the first embodiment, left main body 146 and right main body 148 rotate when desired in response to use of the squeeze handle 124 about the axis 150. The handle 116 has upwardly extending structures forming left gripping members 126 and 128.

Embodiment 110 includes an inner left lateral member end 166 and an outer left lateral member end 168 of left lateral member 142 as well as an inner right lateral member end 170 and an outer right lateral member end 172 of right lateral member 144. Additionally included are left lateral end portion 130, left medial portion 180 and right lateral end portion 132 and right medial portion 182. Also included are outer member base ends 178 and an outer surface 138 of outer member 114. Imaginary plane 158 contains lateral members 130 and 132 and the center 160 of the lid 110.

The second embodiment 110 also includes a lift tab 174 (attached to inner surface 176), an inner member 112, as well as apex (or central area) 122, and an outer member 114 (and axis 156) which are similar to similarly numbered members 12 and 14 of embodiment 10. Additionally, included is a peripheral member 136 having an edge 140 for engaging walls 114. The peripheral member 136 is attached to the inner member 112 as well as to the gripping members 118 and 120 having left base end 162 and right base end 164. However, unlike similarly numbered component structures of lid 10, the outer member 114 is not circular but is instead square and peripheral member 136 is not circular but is instead square. These component structures are square in order to conform to and generally accommodate square (in section) containers such as are purveyed for foods. In all other respects, embodiment 110 is the same as correspondingly numbered structures of embodiment 10 so their description and function will not be repeated in order to promote brevity.

As with the first and second embodiments, the third embodiment 210 of the invention also provides an interior lid 210 for insertion in a suitable container filled to a certain extent. Embodiment 210 includes a left main body 246 and a right main body 248 as well as a left gripping member 226 and a right gripping member 228. Like the first and second embodiments, left main body 246 and right main body 248 rotate when desired in response to use of the squeeze handle 224 about the axis 250. The handle 216 has upwardly extending structures forming left gripping members 226 and 228.

Embodiment 210 includes an inner left lateral member end 266 and an outer left lateral member end 268 of left lateral member 242 as well as an inner right lateral member end 270 and an outer right lateral member end 272 of right lateral member 244. Additionally included are left lateral end portion 230 and a left medial portion 280 and right lateral end portion 232 and right medial portion 282. Also included are outer member base ends 278 and an outer surface 238 of outer member 214. Plane 258 contains lateral members 230 and 232 and the center 260 of the lid 210.

The third embodiment 210 also includes a lift tab 274 (attached to inner surface 276), an inner member 216, as well as apex (or central area) 234 and an outer member 218 (and axis 256) which are similar to similarly numbered members 12 and 14 and structures of embodiment 10. Additionally, a peripheral member 236 having an edge 240 for engaging walls 214 is included. Peripheral member 236 is attached to the inner member 212 as well as to the gripping members 226 and 228 having left base end 262 and right base end 264. However, unlike similarly numbered component structures of lid 10, the inner member 216 is not conical and does not have a cone top, tip or point like the apex 34 of embodiment 10 but is instead curved. The curvature is downward and outward from the apex 234. The inner member 216 is thus convex or dome-shaped. In all other respects, embodiment 210 is the same as correspondingly numbered structures of embodiment 10 so their description and function will not be repeated in order to promote brevity, As with the first embodiment 10, second embodiment 110 and third embodiment 210, the fourth embodiment 310 of the invention also provides an interior lid 310 for insertion in a suitable container to preserve its contents. Embodiment 310 includes a left main body 346 and a right main body 348 as well as a left gripping member 326 and a right gripping member 328. Like the first and second embodiments, left main body 346 and right main body 348 rotate when desired in response to use of the squeeze handle 324 about the axis 350. The handle 324 has upwardly extending structures forming left and right gripping members 326 and 328.

Embodiment 310 includes an inner left lateral member end 366 and an outer left lateral member end 368 of left lateral member 342 as well as an inner right lateral member end 370 and an outer right lateral member end 372 of right lateral member 344. Additionally included are left lateral end portion 330 and left medial portion 380 and right lateral end portion 332 and right medial portion 382. Also included are outer member base ends 378 and an outer surface 338 of outer member 318. Plane (imaginary) 358 contains lateral members 342 and 344 and the center 360 of the lid 310.

The fourth embodiment 310 also includes a lift tab 374 (attached to inner surface 376), an inner member 316, as well as apex (or central area) 334 and an outer member 318 (and axis 356) which are similar to similarly numbered members 16 and 18 of embodiment 10. Additionally, a peripheral member 336 having an edge 340 is included. Peripheral member 336 is attached to the inner member 316 as well as to the gripping members 326 and 328 having left base end 362 and right base end 364. However, unlike similarly numbered component structures of lid 10, the inner member 316 is not conical and does not have a cone top or point at the apex 334 but is instead approximately longitudinally straight. The left and right lateral end portions 330 and 332 drop downwardly toward longitudinal axis 350. The inner member 316 thus folds along the straight portion 384 via rotation about the axis 350 in response to use of the squeeze handle 324. This design facilitates folding of the lid 310. The straight portion 384 extends straight in a direction parallel to the axis 350. The portion 384 is raised outward from the longitudinal axis 350 and also generally from the center 360. In addition, the lateral members 342 and 344 are not entirely flat and in the plane 358, as in other embodiments. Instead, inner left lateral member portion 390 is curved downward and inner right lateral member portion 392 is curved downward. The inner left lateral member end 366 and inner right lateral member end 370 are not in the plane 358 but are rather below the plane 358. The left medial portion 380 and thus the left base end 362 (at that portion) are preferably approximately two mm below the plane 358. Similarly, the right medial portion 382 and right base end 364 (at that portion) are preferably approximately two mm below the plane 358. In all other respects, embodiment 310 is the same as correspondingly numbered structures of embodiment 10 so their description and function will not be repeated in order to promote brevity.

Accordingly, there has been provided a lid which in response to squeezing of a handle thereof can be sufficiently collapsed to be inserted into a smaller mouth of a container. The collapsed configuration also enables the lid to be moved within the container to place it in a desired position deemed best for sealing of the container and preservation of its contents. The lid may also be removed and reinstalled in that container or in another suitable container for repeated use. Although the invention has been described with regard to the specific embodiments set forth herein, many alternative embodiments, modifications and variations will be apparent to those skilled in the art in light of the disclosure set forth herein. Accordingly, it is intended to include all such alternative embodiments, modifications and variations that fall within the sprit and scope of the invention as set forth in the claims hereinbelow.

The invention claimed is:

1. An interior lid for a container, comprising:

an inner member having end portions, said inner member having a raised portion that is raised relative to said end portions, said raised portion extending in the lateral and longitudinal dimensions of the lid;

an outer member at said end portions of said inner member;

a peripheral member at outer surface of the outer member;

a handle at the top surface of the inner member said handle including a pair of gripping members comprising a left gripping member and a right gripping member, said left gripping member and said right gripping member positioned to enable a user to move said pair of gripping members together to collapse said inner member and outer member and said peripheral members horizontally inwardly to reduce horizontal dimension of the lid to facilitate manual insertion of the lid into the container;

said pair of gripping members extending vertically upward from said raised portion and extending vertically downward from said raised portion to facilitate collapse of said inner member and outer member via moving said pair of gripping members together.

2. The lid of claim 1 wherein said pair of gripping members is curved outwardly from central area of said inner member and positioned so that they are in opposing orientation to enable squeezing together of said pair of gripping members for horizontally collapsing the lid.

3. The lid of claim 1 wherein said pair of gripping members are semi-cylindrical and have a select degree of curvature and select dimensions to accommodate thumb and forefinger of a user.

4. The lid of claim 1 wherein said left gripping member has left ends and said right gripping member has right ends, said left ends and said right ends extending to said outer member.

5. The lid of claim 1 further including a left main body containing said left gripping member and a right main body containing said right gripping member and wherein said inner member is vertically raised at a central area at maximal extent relative to a plane that includes outer member base ends and center of the lid to facilitate desired folding together of said left main body and said right main body in response to squeezing of said handle to thereby produce desired collapse of the lid.

6. The lid of claim 1 further including a left and right lateral members positioned at said left and right gripping members and at inner surfaces of said outer member and wherein said left gripping member extends vertically upwardly approximately fifteen mm from said left later member and said right gripping member extends vertically upwardly approximately fifteen mm from said right lateral member.

7. The lid of claim 1 wherein said inner member is raised vertically at the apex thereof approximately five mm relative to a plane that includes outer member base ends and center of the lid.

8. The lid of claim 1 wherein said peripheral member is securely attached to said outer member at the outer surface of said outer member and at lower portion of said outer member and extending radially outwardly relative to the center of said inner member and horizontally outwardly from said outer member.

9. The lid of claim 1 wherein said peripheral member is attached to said outer member at medial portion thereof and extending radially outward relative to the center of said inner member and horizontally outward from said outer member and around entirety of said outer member.

10. The lid of claim 1 wherein said peripheral member extends outwardly relative to the center of said outer member so that it is oriented approximately perpendicular to walls of the container when the lid is installed in the container in a desired sealing position.

11. The lid of claim 1 wherein said peripheral member is circular in order to make full sealing contact with walls for the container when installed therein in a desired sealing position.

12. The lid of claim 1 wherein said peripheral member is square in order to accommodate a square in cross-section container to make full sealing contact with walls of the container when installed therein in a desired sealing position.

13. The lid of claim 1 wherein said peripheral member is sufficiently resilient and of a sufficient horizontal radial width to accommodate out of round imperfections in circular shape of corresponding interior walls of the container and thereby provide sealing thereof and wherein said inner member and said outer member are composed of a material having characteristic of memory so that after said handle is released from squeezed position in which said inner and outer and peripheral members are collapsed, said inner, outer and peripheral members revert back to their original orientations in which they provide desired sealing of the container.

14. The lid of claim 6 wherein said left and right lateral members are flat planar and further including a pull tab attached to said outer member at an inner surface thereof, said pull tab extending vertically upward from said outer member and of sufficient dimensional size to enable a user to grasp said pull tab and pull said lid up through the container to facilitate removal of the lid from the container and repositioning of the lid within the container.

15. An interior lid for a container, comprising:

an inner member having end portions, said inner member having a raised portion that is raised relative to said end portions, said raised portion extending in the lateral and longitudinal dimensions of the lid;

an outer member at said end portions of said inner member;

a peripheral member at outer surface of the outer member;

a handle at the top surface of the inner member said handle including a pair of gripping members comprising a left gripping member and a right gripping member, said left gripping member and said right gripping member positioned to enable a user to move said pair of gripping members together to collapse said inner member and outer member and said peripheral members horizontally inwardly to reduce horizontal dimension of the lid to facilitate manual insertion of the lid into the container;

said pair of gripping members extending vertically upward from said raised portion and extending vertically downward from said raised portion and extending downward a considerable distance relative to height of the lid to facilitate collapse of said inner member and outer member via moving said pair of gripping members together;

a left main body containing said left gripping member and a right main body, containing said right gripping member;

said left gripping member and said right gripping member spaced apart to enable a rotational movement of the left main body and the right main body relative to each other and said left gripping member and said right gripping member are spaced apart a select distance which is sufficiently large to enable an operational rotational movement to be a substantial portion of a total possible range of rotational movement consisting of a change in position from one position in which said left main body and said right main body are in an extended orientation and approximately straight in the same lateral dimension to another position which said left main body and said right main body are folded together so that they are approximately in mutual contact to collapse said inner and outer members and said peripheral members horizontally inwardly to reduce horizontal dimension of the lid to facilitation manual insertion of the lid into the container.

16. The lid of claim 15 wherein said pair of gripping members is curved outwardly from central area of said inner member and positioned so that they are in opposing orientation to enable squeezing together of said pair of gripping members for horizontally collapsing the lid.

17. The lid of claim 15 wherein said pair of gripping members are semi-cylindrical and have a select degree of curvature and select dimensions to accommodate thumb and forefinger of a user.

18. The lid of claim 15 wherein said left gripping member has left ends and said right gripping member has right ends, said left ends and said right ends extending to said outer member.

19. The lid of claim 15 further including a left main body containing a left gripping member and a right main body containing said right gripping member and wherein said inner member is vertically raised at a central area at maximal extent relative to a plane that includes outer member base ends and center of the lid to facilitate desired folding together of said left main body and said right main body in response to squeezing of said handle to thereby produce desired collapse of the lid.

20. The lid of claim 15 further including a left lateral member and a right lateral member positioned at said left gripping member and said right gripping member and at inner surfaces of said outer member and wherein said left gripping member extends vertically upwardly from said left later member and said right gripping member extends vertically upwardly from said right lateral member.

21. The lid of claim 15 wherein said peripheral member is securely attached to said outer member at the outer surface of said outer member and at lower portion of said outer member and extending radially outwardly relative to the center of said inner member and horizontally outwardly from said outer member.

22. The lid of claim 15 wherein said peripheral member is square in order to accommodate a square in cross-section container to make full sealing contact with walls of the container when installed therein in a desired sealing position.

* * * * *